US008843035B2

(12) United States Patent
Shimizu et al.

(10) Patent No.: US 8,843,035 B2
(45) Date of Patent: Sep. 23, 2014

(54) DEVELOPING DEVICE AND IMAGE FORMING APPARATUS PROVIDED WITH SAME

(71) Applicant: KYOCERA Document Solutions Inc., Osaka (JP)

(72) Inventors: Tamotsu Shimizu, Osaka (JP); Shizuka Okada, Osaka (JP)

(73) Assignee: Kyocera Document Solutions Inc. (JP)

( * ) Notice: Subject to any disclaimer, the term of this patent is extended or adjusted under 35 U.S.C. 154(b) by 62 days.

(21) Appl. No.: 13/788,708

(22) Filed: Mar. 7, 2013

(65) Prior Publication Data

US 2013/0243496 A1 Sep. 19, 2013

(30) Foreign Application Priority Data

Mar. 14, 2012 (JP) ..... 2012-056688

(51) Int. Cl.
*G03G 15/09* (2006.01)
*G03G 15/08* (2006.01)

(52) U.S. Cl.
CPC ..... *G03G 15/0877* (2013.01); *G03G 15/0914* (2013.01); *G03G 15/0812* (2013.01)
USPC ..... 399/274; 399/275; 399/276

(58) Field of Classification Search
USPC ..... 399/107, 110, 119, 120, 252, 258, 267, 399/274–276
See application file for complete search history.

(56) References Cited

U.S. PATENT DOCUMENTS

| | | | | |
|---|---|---|---|---|
| 4,887,131 | A | 12/1989 | Kinoshita et al. | |
| 7,043,182 | B2 * | 5/2006 | Sakai et al. | 399/284 |
| 8,396,401 | B2 * | 3/2013 | Akedo | 399/274 |
| 2005/0185974 | A1 | 8/2005 | Terai | |
| 2006/0120768 | A1 * | 6/2006 | Kurosu | 399/267 |
| 2009/0010683 | A1 * | 1/2009 | Morimoto et al. | 399/276 |
| 2011/0150539 | A1 | 6/2011 | Mabuchi et al. | |

FOREIGN PATENT DOCUMENTS

| | | |
|---|---|---|
| JP | 2003-167426 | 6/2003 |
| JP | 2007155813 | 6/2007 |

* cited by examiner

*Primary Examiner* — Hoan Tran
(74) *Attorney, Agent, or Firm* — Gerald E. Hespos; Michael J. Porco; Matthew T. Hespos

(57) ABSTRACT

A developing device includes a developer bearing member, a layer restricting member, a facing magnet and a nonmagnetic member. The developer bearing member has a sleeve for bearing magnetic toner and a fixed magnet included inside the sleeve. The layer restricting member faces one magnetic pole of the fixed magnet, is arranged at a distance from the sleeve and made of a magnetic material. The facing magnet is arranged upstream of the layer restricting member in a rotation direction of the sleeve and at a distance from the sleeve, includes a first facing surface facing a position overlapping with a position with a maximum magnetic force of the one magnetic pole and has a magnetic pole having the same polarity as the one magnetic pole on the first facing surface. The nonmagnetic member is connected at an upstream side of the facing magnet in the rotation direction.

16 Claims, 12 Drawing Sheets

THICKNESS(W): 4mm

| | HEIGHT(H) | | |
|---|---|---|---|
| | 0~0.5mm | 0.5~1.0mm | 1.0~1.5mm |
| LONGITUDINAL STREAK | ○ | ○ | △ |

DEVELOPING DEVICE AND IMAGE FORMING APPARATUS PROVIDED WITH SAME

This application is based on Japanese Patent application No. 2012-056688 filed in Japan Patent Office on Mar. 14, 2012, the contents of which are hereby incorporated by reference.

BACKGROUND

The present disclosure relates to a developing device for developing an electrostatic latent image formed on an image bearing member using magnetic one-component developer and an image forming apparatus provided with this developing device.

Conventionally, a developing device as described below is known as a developing device used in an image forming apparatus such as a printer and configured to develop an electrostatic latent image formed on an image bearing member using magnetic one-component developer. Such a developing device includes a rotary sleeve including a fixed magnet therein and a toner layer thickness restricting member for restricting the thickness of a toner layer formed on the rotary sleeve. The toner layer thickness restricting member includes a blade formed of a magnetic plate-like member and a magnet mounted on an upstream side of this blade in a rotation direction of the rotary sleeve.

In the above technology, out of the fixed magnet inside the rotary sleeve, a magnetic pole having the same polarity as the magnet of the toner layer thickness restricting member is arranged at a position facing the toner layer thickness restricting member. A thin layer of toner can be formed by the magnets having the same polarity facing each other in an area where the toner layer is restricted. As a result, toner charging is improved and image quality defect such as fogging is suppressed.

When the magnets having the same polarity are arranged to face each other and a thin layer of toner is formed by a repulsive magnetic field in restricting the layer of the magnetic one-component developer as described above, the conveyance of toner may become unstable. In this case, an unstable state of conveying the toner on the rotary sleeve leads to uneven toner supply to the image bearing member. As a result, image defects such as longitudinal streaks may be caused in a printed image.

The present disclosure was developed to solve the above problem and aims to prevent a failure in conveying developer in restricting a layer of magnetic one-component developer.

SUMMARY

A developing device according to one aspect of the present disclosure includes a developer bearing member, a layer restricting member, a facing magnet and a nonmagnetic member. The developer bearing member has a hollow cylindrical shape, is driven and rotated and includes a sleeve for bearing magnetic toner on a circumferential surface and a fixed magnet included inside the sleeve and having a plurality of magnetic poles in a circumferential direction of the sleeve. The layer restricting member faces one magnetic pole out of the plurality of magnetic poles of the fixed magnet, is arranged at a distance from the sleeve and made of a magnetic material and restricts the thickness of the magnetic toner on the sleeve. The facing magnet is arranged upstream of the layer restricting member in a rotation direction of the sleeve and at a distance from the sleeve, includes a first facing surface facing a position overlapping with a position with a maximum magnetic force of the one magnetic pole out of the plurality of magnetic poles in a radial direction and has a magnetic pole having the same polarity as the one magnetic pole on the first facing surface. The nonmagnetic member is connected at an upstream side of the facing magnet in the rotation direction and arranged at a distance from the sleeve.

An image forming apparatus according to another aspect of the present disclosure includes an image bearing member and the developing device. An electrostatic latent image is formed on a surface of the image bearing member. The developing device supplies toner to the image bearing member.

These and other objects, features and advantages of the present disclosure will become more apparent upon reading the following detailed description along with the accompanying drawings.

DETAILED DESCRIPTION

Figure 1:
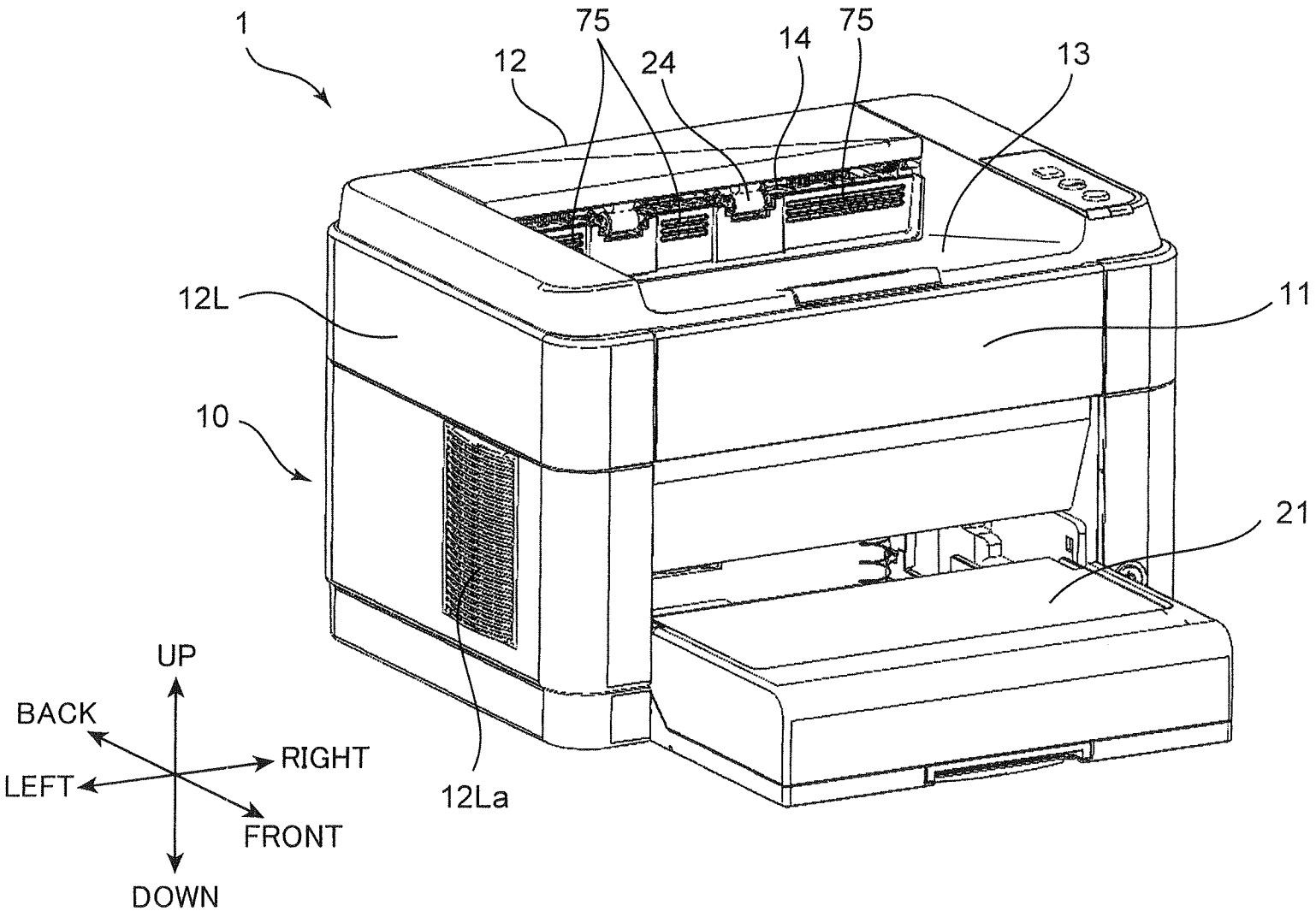
FIG. 1 is a perspective view showing the external appearance of an image forming apparatus according to one embodiment of the present disclosure.
Figure 2:
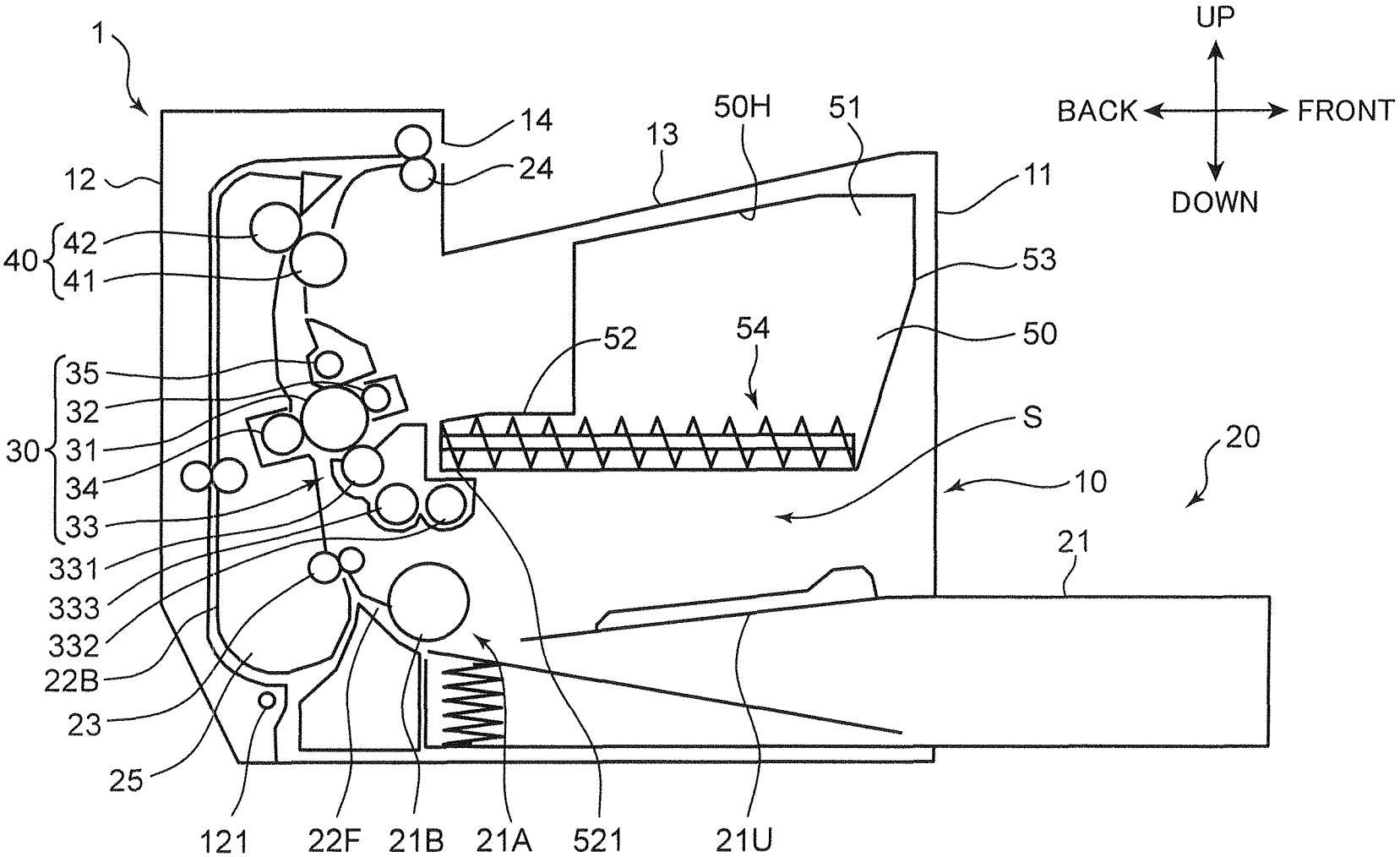
FIG. 2 is a sectional view showing the internal structure of the image forming apparatus according to the embodiment of the present disclosure.

Hereinafter, an embodiment of the present disclosure is described in detail based on the drawings. FIG. 1 is a perspective view showing the external appearance of an image forming apparatus 1 according to one embodiment of the present disclosure. FIG. 2 is a sectional view showing the internal structure of the image forming apparatus 1 according to the embodiment of the present disclosure. Although a monochrome printer is illustrated as the image forming apparatus 1 here, the image forming apparatus may be a copier, a facsimile machine or a complex machine provided with these functions or may be an image forming apparatus for forming a color image.

The image forming apparatus 1 includes a main housing 10 having a substantially rectangular parallelepipedic housing structure and a sheet feeding unit 20, an image forming unit 30, a fixing unit 40 and a toner container 50 housed in this main housing 10.

A front cover 11 is provided on the front side of the main housing 10 and a rear cover 12 is provided on the rear side. By opening the front cover 11, the toner container 50 is exposed on the front side. This enables a user to take out the toner container 50 from the front side of the main housing 10 when toner runs out. The rear cover 12 is a cover which is opened in the event of a sheet jam and maintenance. The respective image forming unit 30 and fixing unit 40 can be taken out from the rear side of the main housing 10 by opening the rear cover 12. Further, a left cover 12L (FIG. 1) and a right cover 12R (not shown in FIG. 1) opposite to the left cover 12L are respectively arranged on side surfaces of the main housing 10 to extend in a vertical direction. An air inlet 12La for taking in air into the main housing 10 is arranged on a front part of the left cover 12L. Further, a sheet discharging portion 13 to which a sheet after image formation is to be discharged is provided on the upper surface of the main housing 10. Various devices for performing image formation are housed in an inner space S (FIG. 2) defined by the front cover 11, the rear cover 12, the left cover 12L and the right cover 12R and the sheet discharging portion 13.

The sheet feeding unit 20 includes a sheet cassette 21 storing sheets to which an image forming process is to be applied (FIG. 2). A part of this sheet cassette 21 projects forward from the front surface of the main housing 10. The upper surface of a part of the sheet cassette 21 housed in the main housing 10 is covered by a sheet cassette ceiling plate 21U. The sheet cassette 21 includes a sheet storage space in which a stack of the sheets is stored, a lift plate for lifting up the stack of sheets for sheet feeding, and the like. A sheet pickup portion 21A is provided above a rear end side of the sheet cassette 21. A feed roller 21B for feeding the uppermost sheet of the sheet stack in the sheet cassette 21 one by one is arranged in this sheet pickup portion 21A.

The image forming unit 30 performs the image forming process for forming a toner image on a sheet fed from the sheet feeding unit 20. The image forming unit 30 includes a photoconductive drum 31 (image bearing member) and a charging device 32, an exposing device (not shown in FIG. 2), a developing device 33, a transfer roller 34 and a cleaning device 35 arranged around this photoconductive drum 31. The image forming unit 30 is arranged between the left cover 12L and the right cover 12R.

The photoconductive drum 31 includes a rotary shaft and a cylindrical surface which rotates about the rotary shaft. An electrostatic latent image is formed on the cylindrical surface and a toner image in conformity with the electrostatic latent image is carried on the cylindrical surface. A photoconductive drum using an amorphous silicon (a-Si) based material can be used as the photoconductive drum 31.

The charger 32 is for uniformly charging the surface of the photoconductive drum 31 and includes a charging roller held in contact with the photoconductive drum 31.

The cleaning device 35 includes an unillustrated cleaning blade, cleans toner adhering to the circumferential surface of the photoconductive drum 31 and conveys the toner to an unillustrated collection device.

The exposure device includes optical devices such as a laser light source, mirrors and lenses and forms an electrostatic latent image by irradiating laser light modulated based on image data given from an external apparatus such as a personal computer to the circumferential surface of the photoconductive drum 31.

The developing device 33 supplies toner to the circumferential surface of the photoconductive drum 31 to develop the electrostatic latent image on the photoconductive drum 31 and form a toner image. The developing device 33 includes a developing roller 331 for bearing the toner to be supplied to the photoconductive drum 31 and a first agitating screw 332 and a second agitating screw 333 for conveying developer in a circulating manner while agitating the developer in a development housing 330.

The transfer roller 34 is a roller for transferring a toner image formed on the circumferential surface of the photoconductive drum 31 onto a sheet. The transfer roller 34 is held in contact with the cylindrical surface of the photoconductive drum 31 to form a transfer nip portion. A transfer bias having a polarity opposite to that of the toner is applied to this transfer roller 34.

The fixing unit 40 performs a fixing process for fixing a transferred toner image onto a sheet. The fixing unit 40 includes a fixing roller 41 having a heat source provided inside and a pressure roller 42 pressed in contact with this fixing roller 41 and forming a fixing nip portion between the fixing roller 41 and the pressure roller 42. When a sheet having a toner image transferred thereto is passed through the fixing nip portion, the toner image is heated by the fixing roller 41 and pressed by the pressure roller 42, thereby being fixed onto the sheet.

The toner container 50 stores toner to be supplied to the developing device 33. The toner container 50 includes a container main body 51 which serves as a main storage section for the toner, a tubular portion 52 projecting from a lower part of one side surface of the container main body 51, a lid member 53 covering another side surface of the container main body 51 and a rotary member 54 housed in the container and configured to convey the toner. The toner stored in the toner container 50 is supplied into the developing device 33 through a toner discharge opening 521 provided on the lower surface of the leading end of the tubular portion 52 by driving and rotating the rotary member 54. Further, a container ceiling plate 50H covering an upper side of the toner container 50 is located below the sheet discharging portion 13 (see FIG. 2).

A main conveyance path 22F and a reversing conveyance path 22B are provided to convey a sheet in the main housing 10. The main conveyance path 22F extends from the sheet pickup portion 21A of the sheet feeding unit 20 to a sheet discharge opening 14 provided to face the sheet discharging portion 13 on the upper surface of the main housing 10 via the image forming unit 30 and the fixing unit 40. The reversing conveyance path 22B is a conveyance path for returning a sheet having one side printed to a side of the main conveyance path 22F upstream of the image forming unit 30 in the case of printing both sides of the sheet.

The main conveyance path 22F extends to pass the transfer nip portion formed by the photoconductive drum 31 and the transfer roller 34 from below to above. Further, a registration roller pair 23 is arranged at a side of the main conveyance path 22F upstream of the transfer nip portion. A sheet is temporarily stopped at the registration roller pair 23 and fed to the transfer nip portion at a predetermined timing for image transfer after a skew correction is made. A plurality of conveyor rollers for conveying the sheet are arranged at suitable positions of the main conveyance path 22F and the reversing conveyance path 22B. For example, a discharge roller pair 24 is arranged near the sheet discharge opening 14.

The reversing conveyance path 22B is formed between the outer side surface of a reversing unit 25 and the inner surface of the rear cover 12 of the main housing 10. Note that the transfer roller 34 and one roller of the registration roller pair 23 are mounted on the inner side surface of the reversing unit 25. The rear cover 12 and the reversing unit 25 are respectively rotatable about a shaft of a supporting point portion 121 provided on bottom ends thereof. If a sheet jam occurs in the reversing conveyance path 22B, the rear cover 12 is opened. If a sheet jam occurs in the main conveyance path 22F or a unit including the photoconductive drum 31 or the developing device 33 is taken out, the reversing unit 25 is opened in addition to the rear cover 12.

<Description of the Developing Device>

Figure 3:
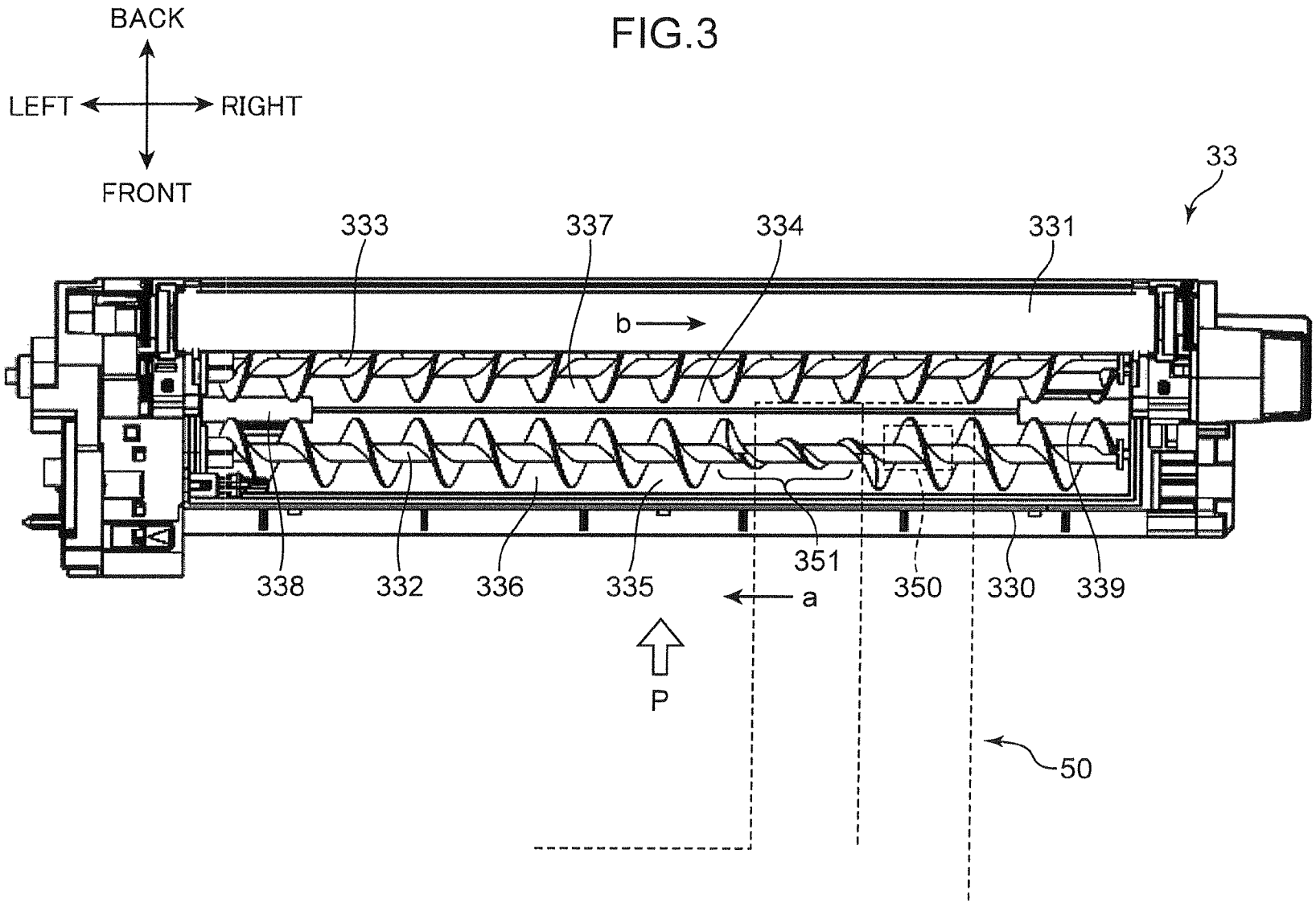
FIG. 3 is a plan view of a developing device according to the embodiment of the present disclosure.

FIG. 3 is a plan view showing the internal structure of the developing device 33. The developing device 33 includes the box-shaped development housing 330 long in one direction (axial direction of the developing roller 331) and the development housing 330 has an inner space 335. The developing roller 331 and the first and second agitating screws 332, 333 are arranged in parallel in the inner space 335. In this embodiment, magnetic toner is filled as magnetic one-component developer in this inner space 335.

The toner is agitated and conveyed in the inner space 335 and consumed by being successively supplied to the developing roller 331 to develop an electrostatic latent image. Replenishing toner is appropriately supplied from the toner container 50 to correspond to the consumed amount.

The developing roller 331 has a hollow cylindrical shape extending in a longitudinal direction of the development housing 330 and includes a sleeve part, which is driven and rotated, on the outer periphery. The toner carried on a sleeve surface is conveyed to an opening (not shown) arranged in the development housing 330 and supplied to the facing photoconductive drum 31. A developing bias is applied to the developing roller 331 from an unillustrated bias application means. The developing bias is a bias in which an AC voltage is superimposed on a DC voltage. Note that the structure of the developing roller 331 is described in detail later.

The inner space 335 of the development housing 330 is partitioned into a first passage 336 and a second passage 337 long in a lateral direction by a partition plate 334 extending in the lateral direction. The partition plate 334 is shorter than the width of the development housing 330 in the lateral direction, and an upstream communicating portion 338 and a downstream communicating portion 339 respectively allowing communication between the first and second passages 336, 337 are provided on the right and left ends of the partition plate 334. In this way, a circulation path extending from the first passage 336, the upstream communicating portion 338, the second passage 337 to the downstream communicating portion 339 is formed in the development housing 330.

The first agitating screw 332 is housed in the first passage 336 and the second agitating screw 333 is housed in the second passage 337. Each of the first and second agitating screws 332, 333 includes a rotary shaft and an agitating blade spirally projecting on the outer periphery of this rotary shaft. The first agitating screw 332 conveys the toner in a direction of arrow "a" of FIG. 3 by being driven and rotated about the rotary shaft. On the other hand, the second agitating screw 333 conveys the toner in a direction of arrow "b" of FIG. 3 by being driven and rotated about the rotary shaft. By driving and rotating the first and second agitating screws 332, 333, the toner is conveyed in a circulating manner along the above circulation path.

Note that the first and second agitating screws 332, 333 of the developing device 33 are normally covered by an unillustrated ceiling plate. A toner supply opening 350 through which the toner is supplied to the developing device 33 is an opening perforated in this ceiling plate and arranged above the vicinity of the right end of the first passage 336 (dotted-line part of FIG. 3). The toner container 50 formed with a toner conveyance path is arranged above the toner supply opening 350. The toner container 50 is so assembled with the developing device that a longitudinal direction of the toner container 50 (direction in which the toner conveyance path is formed) is perpendicular to a longitudinal direction of the developing device (developer conveying direction of the first agitating screw 332). The toner dropped from the toner container 50 is supplied to the developing device 33 via the toner supply opening 350.

The toner supplied from a toner discharge opening 521 of the toner container 50 drops into the first passage 336 and is mixed with the existing toner and conveyed in the direction of arrow "a" by the first agitating screw 332. At this time, the toner is agitated and charged.

Here, a conveyance ability suppressing portion 351 is provided on a side of the first agitating screw 332 downstream of the toner supply opening 350 in a toner conveying direction. The conveyance ability suppressing portion 351 is a part where the agitating blade of the first agitating screw 332 is partly missing, and the conveyed amount of the toner in this missing part is lower than that in other parts. Thus, the toner being conveyed in the first passage 336 is retained at a side upstream of the conveyance ability suppressing portion 351 in the conveying direction.

Note that although the part of the first agitating screw 332 where the agitating blade is missing serves as the conveyance ability suppressing portion 351 in this embodiment, a bar member may be arranged in parallel to the rotary shaft on a peripheral edge part of the agitating blade of the first agitating screw 332 and a part where this bar member is attached may serve as the conveyance ability suppressing portion 351. By the bar member attached to the agitating blade, toner conveyance ability can be suppressed and the toner can be retained.

By providing the conveyance ability suppressing portion 351, the toner being conveyed in the direction of arrow "a" in the first passage 336 is retained at a position immediately upstream of the conveyance ability suppressing portion 351 and facing the toner supply opening 350, whereby a retention portion is formed. Thus, when the toner is supplied through the toner supply opening 350 to increase the amount of the toner in the development housing 330, the toner retained in this retention portion acts to close the toner supply opening 350, thereby suppressing any further toner supply. Thereafter, when the toner in the development housing 330 is consumed and the toner retained in the retention portion decreases, the toner that has closed the toner supply opening 350 decreases and the toner comes to flow in through the toner discharge opening 521.

<Peripheral Structure of the Developing Roller 331>

Figure 4:
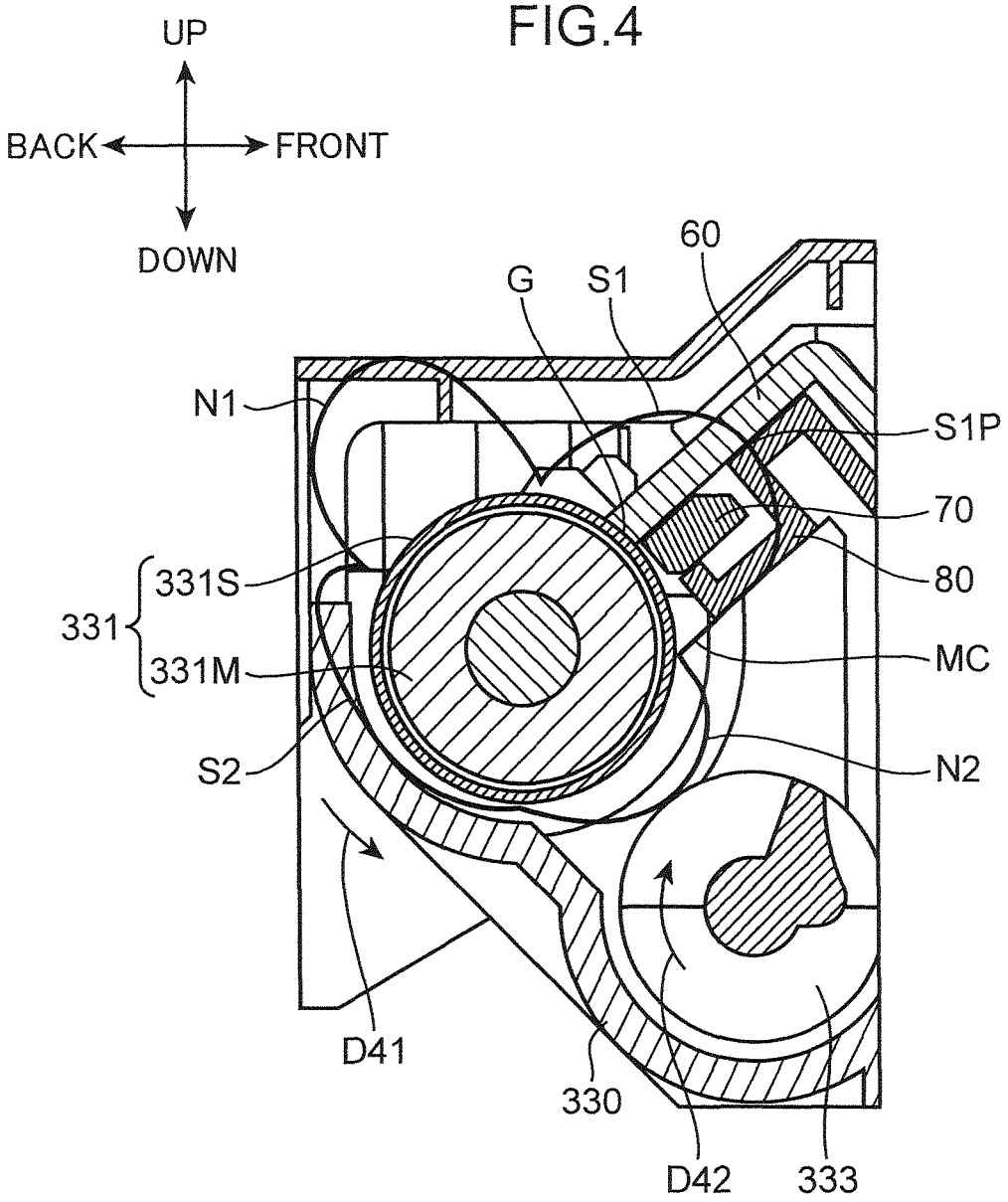
FIG. 4 is an enlarged sectional view of the developing device according to the embodiment of the present disclosure.
Figure 5:
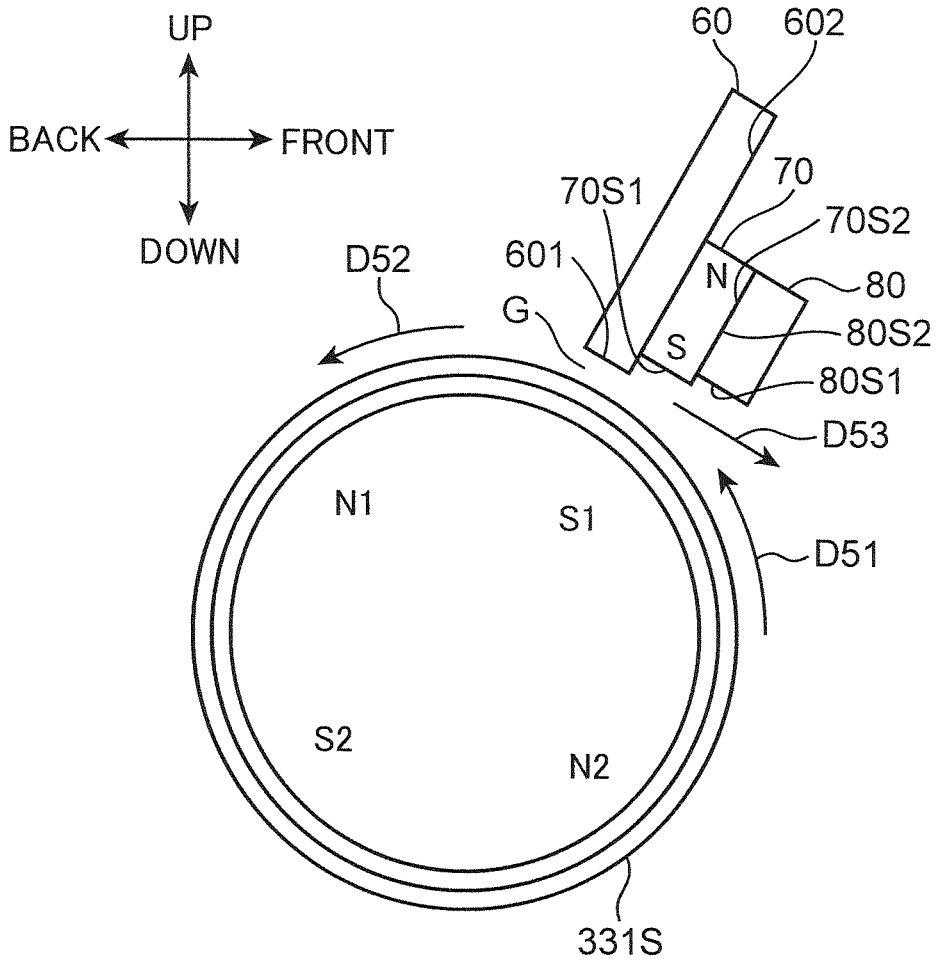
FIG. 5 is a diagrammatic sectional view of a developing roller and its peripheral devices according to the embodiment of the present disclosure.

Next, a structure around the developing roller 331 of the developing device 33 according to this embodiment is described in detail. FIG. 4 is a sectional view enlargedly showing the developing roller 331 and its surrounding in the developing device 33. FIG. 4 is a sectional view along a plane perpendicular to a rotary shaft of the developing roller 331. FIG. 5 is a diagrammatic sectional view showing the movement of the toner around the developing roller 331.

The developing roller 331 (developer bearing member) includes a sleeve 331S having a hollow cylindrical shape and to be driven and rotated, and a magnet 331M (fixed magnet) fixedly arranged along the axial direction in the sleeve 331S and having a solid cylindrical shape. The sleeve 331S is driven and rotated in a direction of arrow D41 by an unillustrated driving means and carries the magnetic toner on the circumferential surface. The magnet 331M is a fixed magnet having a plurality of magnetic poles in a circumferential direction of the sleeve 331S in the sleeve 331S. The magnet 331M has four magnetic poles S1 pole, N1 pole, S2 pole and N2 pole arranged in the circumferential direction.

The S1 pole is arranged at a front upper position of the magnet 331M and used to restrict a toner layer. The N1 pole is arranged at a rear upper position of the magnet 331M and has a function of supplying the toner to the photoconductive drum 31 as a developing pole. The N2 pole is arranged at a front lower position of the magnet 331M and has a function of scooping up the toner to the developing roller 331. The S2 pole is arranged at a position of the magnet 331M downstream of the N1 pole in a rotation direction of the sleeve 331S and upstream of the N2 pole in the rotation direction of the sleeve 331S. The S2 pole is mainly arranged at a rear lower position of the magnet 331M and has a function of collecting the toner, which is not moved toward the photoconductive drum 31 at the N1 pole, into the development housing 330. In FIG. 4, a curve MC surrounding the developing roller 331 shows a distribution of a radial magnetic force of the developing roller 331 brought about by the respective magnetic poles in the circumferential direction on the sleeve 331S.

The second agitating screw 333 is arranged at a position before and below the developing roller 331. Specifically, the second agitating screw 333 is arranged to face the N2 pole of the magnet 331M and is rotated in a direction of arrow D42 of FIG. 4.

The developing device 33 further includes a layer restricting member 60, a magnet plate 70 and a nonmagnetic plate 80.

The layer restricting member 60 is arranged at a position before and above the developing roller 331. The layer restricting member 60 is arranged along the axial direction of the developing roller 331 to face the circumferential surface of the developing roller 331 (sleeve 331S). Specifically, the layer restricting member 60 is arranged to face the S1 pole of the magnet 331M in the developing roller 331. The layer restricting member 60 is a plate-like member made of a magnetic material. The layer restricting member 60 has a roughly L-shape (FIG. 4) and a part facing the developing roller 331 of the layer restricting member 60 has a rectangular shape with longer sides extending in a direction toward the developing roller 331 in a cross-section (FIG. 5) perpendicular to the rotary shaft of the developing roller 331. A leading end portion 601 of the layer restricting member 60 is arranged at a distance from the sleeve 331S of the developing roller 331. As a result, a layer restricting gap G is formed between the leading end portion 601 and the sleeve 331S. The layer restricting member 60 restricts the thickness of a toner layer on the sleeve 331S made of the toner scooped up from the second agitating screw 333.

The magnet plate 70 (facing magnet) is arranged along the layer restricting member 60 on the front side of the layer restricting member 60. In other words, the magnet plate 70 is arranged upstream of the layer restricting member 60 in the rotation direction of the sleeve 331S of the developing roller 331 (arrow D41 of FIG. 4, arrows D51, 52 of FIG. 5). In this embodiment, the magnetic plate 70 is formed of a permanent magnet having a plate-like shape. The magnet plate 70 has a rectangular shape extending along the layer restricting member 60 in a cross-section (FIG. 5) perpendicular to the rotary shaft of the developing roller 331. The magnet plate 70 is fixed to a lower part of a front portion 602 which is a front wall portion of the layer restricting member 60.

The magnet plate 70 includes a magnet lower end portion 70S1 (first facing surface) facing the sleeve 331S of the developing roller 331. Further, the magnet plate 70 includes a magnet vertical wall 70S2 (first wall portion) intersecting with the magnet lower end portion 70S1 at an upstream side of the magnet lower end portion 70S1 in the rotation direction and extending in a direction away from the sleeve 331S. The magnet lower end portion 70S1 is arranged to face a position overlapping with a position with a peak magnetic force S1P (FIG. 4) in a radial direction of the S1 pole of the magnet 331M. The magnet lower end portion 70S1 is arranged at a longer distance from the circumferential surface of the sleeve 331S than the leading end portion 601 of the layer restricting member 60. The magnet plate 70 has an S pole having the same polarity as the S1 pole of the magnet 331M on a side near the developing roller 331. Further, the magnet plate 70 has an N pole at a side more distant from the developing roller 331 than the S pole.

The nonmagnetic plate 80 (nonmagnetic member) is arranged along the magnet plate 70 before the magnet plate 70. In other words, the nonmagnetic plate 80 is connected at a side upstream of the magnet plate 70 in the rotation direction of the sleeve 331S of the developing roller 331 and arranged at a distance from the sleeve 331S. In this embodiment, the nonmagnetic plate 80 has a roughly S-shape in a cross-section (FIG. 4) perpendicular to the rotary shaft of the developing roller 331 and made of ABS resin containing carbon. As shown in FIG. 5, a part facing the developing roller 331 of the nonmagnetic plate 80 has a rectangular shape adhered to the magnet plate 70. Furthermore, as shown in FIG. 5, a section of the nonmagnetic plate 80 apart from the developing roller 331 may has a shape partially spaced apart from the magnet plate 70. The nonmagnetic plate 80 includes a lower end portion 80S1 (second facing surface) facing the sleeve 331S and a vertical wall 80S2 (second wall portion) intersecting with the lower end portion 80S1 at a downstream side of the lower end portion 80S1 in the rotation direction and standing in a direction away from the sleeve 331S. The vertical wall 80S2 of the nonmagnetic plate 80 is arranged in close contact with the magnet vertical wall 70S2 of the magnet plate 70. The lower end portion 80S1 of the nonmagnetic plate 80 is arranged at a longer distance from the sleeve 331S than the magnet lower end portion 70S1 of the magnet plate 70. Note that the lower end portion 80S1 of the nonmagnetic plate 80 and the magnet lower end portion 70S1 of the magnet plate 70 may face the sleeve 331S and be arranged to be flush with each other.

As just described, in this embodiment, the magnet plate 70 is arranged upstream of the layer restricting member 60 in the rotation direction of the developing roller 331 (sleeve 331S). Further, the nonmagnetic plate 80 is arranged upstream of the magnet plate 70 in the rotation direction of the developing roller 331. In other words, the nonmagnetic plate 80, the magnet plate 70 and the layer restricting member 60 are successively arranged to face the circumferential surface of the developing roller 331 from the upstream side toward the downstream side in the rotation direction of the developing roller 331.

<Functions of the Nonmagnetic Plate 80>

Figure 6B:
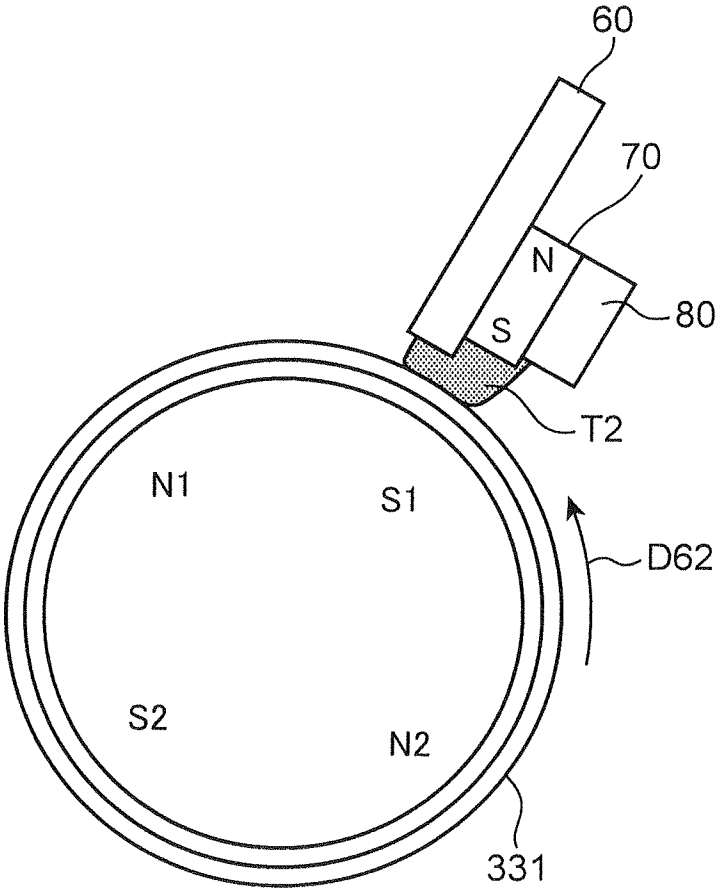
FIGS. 6A and 6B are diagrams showing the function of a nonmagnetic member according to the embodiment of the present disclosure.
Figure 6A:
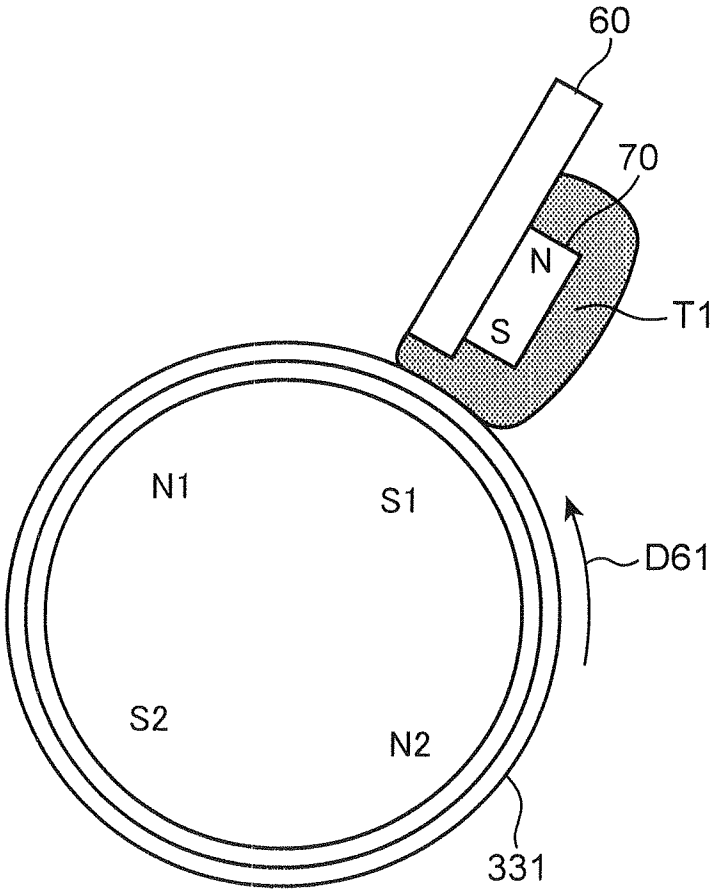
Figure 7:
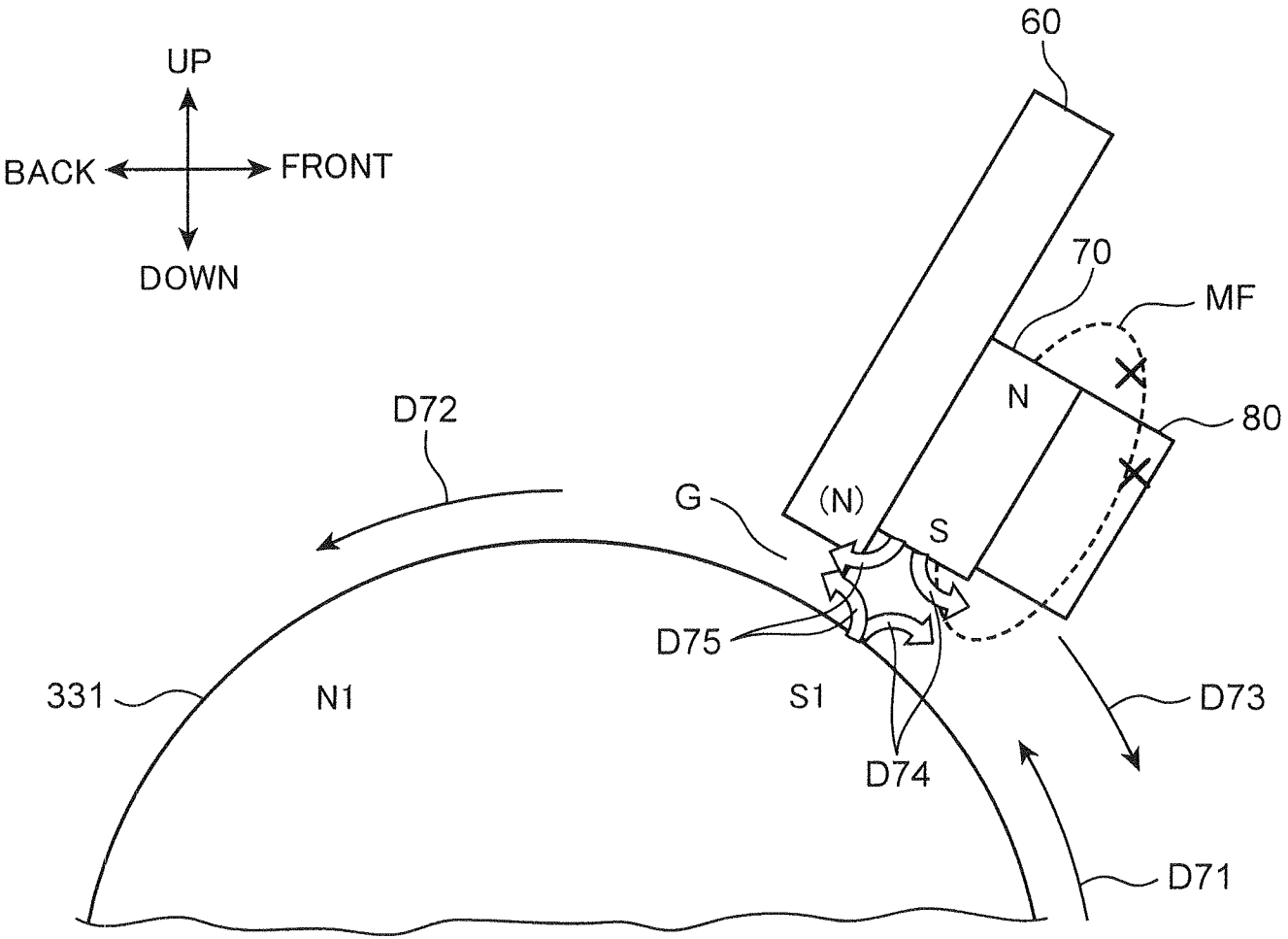
FIG. 7 is a view showing the function of the nonmagnetic member according to the embodiment of the present disclosure.

Next, functions of the developing device 33 according to this embodiment are described. FIGS. 6A, 6B and 7 are diagrammatic sectional views showing distributions and movements of the toner around the developing roller 331. FIG. 6A is a view when the nonmagnetic plate 80 according to this embodiment is not provided, and FIGS. 6B and 7 are views when the nonmagnetic plate 80 according to this embodiment is provided.

With reference to FIG. 6A, the toner scooped up to the sleeve 331S from the second agitating screw 333 is conveyed to an area where the layer restricting member 60 faces the developing roller 331 according to the rotation (arrow D61) of the developing roller 331 (sleeve 331S). The magnet plate 70 is arranged upstream of the layer restricting member 60 in the rotation direction of the developing roller 331 (on the rear side of the layer restricting member 60). At this time, a repulsive magnetic field is formed between the magnet plate 70 and the developing roller 331 by the S1 pole of the magnet 331 and the S pole of the magnet plate 70. The repulsive magnetic field is distributed to have a shape extending along the circumferential direction near the circumferential surface of the sleeve 331S of the developing roller 331. Thus, the toner carried on the developing roller 331 receives such a force as to be brought into close contact with the circumferential surface of the sleeve 331S by the repulsive magnetic field. As a result, a thin layer of the toner is formed on the developing roller 331. On the other hand, a magnetic field MF (see FIG. 7) propagating from the S pole of the magnet plate 70 toward the N pole of the magnet plate 70 through a side before the magnet plate 70 is formed around the magnet plate 70. As a result, the toner conveyed on the developing roller 331 strongly adheres to the magnet plate 70 along the magnetic field MF (T1 of FIG. 6A).

The toner conveyed by the developing roller 331 passes between the magnet plate 70 and the developing roller 331 while being rubbed against the toner adhering to the magnet plate 70 along the magnetic field MF. Thus, the toner on the developing roller 331 is stressed to accelerate the deterioration of the toner. Further, the magnetic field concentrates due to the magnetic toner adhering to the magnet plate 70 along the magnetic field MF and toner conveyance ability is deteriorated on the lower surface of the magnet plate 70. As a result, external additives and the like added to the surfaces of toner particles are buried to reduce toner fluidity and toner chargeability. This may cause a density reduction or toner fogging in a printed image.

To solve such problems, the nonmagnetic plate 80 described above is arranged on the rear surface of the magnet plate 70 in this embodiment. With reference to FIG. 7, the toner does not adhere along the magnetic field MF propagating from the S pole to the N pole of the magnet plate 70 when the nonmagnetic plate 80 is arranged. This prevents the concentration of a magnetic field formed around the magnet plate 70 due to the toner strongly adhering to the magnet plate 70.

As a result, as shown in FIG. 6B, an area where the toner adheres is formed to be smaller between the layer restricting member 60, the magnet plate 70 and the developing roller 331 as compared with the case where the nonmagnetic plate 80 is not provided (FIG. 6A) (T2 of FIG. 6B). Since the amount of the toner attracted to a magnetic field formed by the S1 pole of the magnet 331M, the layer restricting member 60 and the magnet plate 70 is small, the toner is not excessively stressed. Thus, stress to which the toner is subjected when the toner passes (arrow D62 of FIG. 6 and arrow D71 of FIG. 7) the layer restricting gap G is reduced. Further, the repulsive magnetic field (arrow D74 and D75 of FIG. 7) is formed by the effect of the S1 pole of the magnet 331M and the S pole of the magnet plate 70 and the toner can pass (arrow D72 of FIG. 7) the layer restricting gap G after being formed into a thin layer. And redundant toner is conveyed back to a upstream side in the rotation direction of the developing roller 331(arrow D73 of FIG. 7 and arrow D53 of FIG. 5). Therefore, stress subjected to the toner is reduced and the formation of a thin toner layer is realized in a state where toner fluidity is ensured.

Next, a more preferable mode of the nonmagnetic plate 80 in the developing device 33 is described by way of examples. Note that each of the following examples was conducted under the following experimental conditions.

<Concerning Experimental Conditions>

Photoconductive drum 31: OPC drum

Circumferential speed of photoconductive drum 31: 146 mm/sec

Circumferential speed of developing roller 331 (sleeve 331S): 204 mm/sec Layer restricting gap G: 0.3 mm Developing bias AC component: rectangular wave amplitude of 1.7 kV, duty of 60%

Developing bias DC component: 270 V

Surface potential of photoconductive drum 31: 430 V

Diameter of developing roller 331: 16 mm

Diameter of photoconductive drum 31: 24 mm

N1 peak magnetic force of magnet 331M: 80 mT

S1 peak magnetic force of magnet 331M: 80 mT

N2 peak magnetic force of magnet 331M: 30 mT

S2 peak magnetic force of magnet 331M: 20 mT

Average particle diameter of magnetic toner: 6.8 μm (D50: median diameter)

Arrangement of lower end of magnet plate 70 relative to lower end of layer restricting member 60: 0 to 0.5 mm from lower end of layer restricting member 60

<Retracted Height H of the Nonmagnetic Plate 80>

Figure 8:
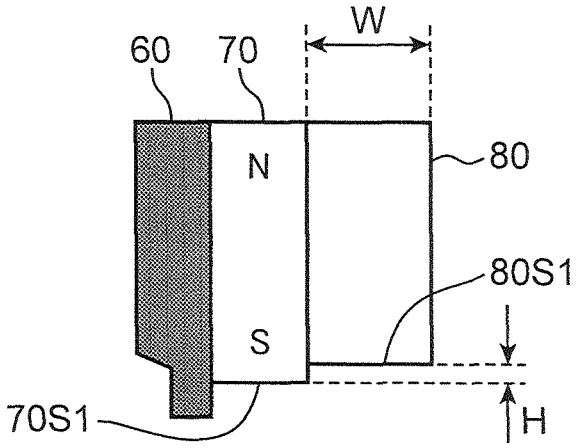
FIG. 8 shows an evaluation result on retracted height H of the nonmagnetic member according to the embodiment of the present disclosure.

FIG. 8 shows an evaluation result of a preferable mode for the arrangement (retracted height H) of the lower end portion 80S1 of the nonmagnetic plate 80 with respect to the magnet lower end portion 70S1 of the magnet plate 70. Note that longitudinal streaks are an image defect which occurs in a half-tone image when there is a failure in toner conveyance in an area from the nonmagnetic plate 80 to the layer restricting member 60. In FIG. 8, longitudinal streak ○ indicates a state where almost no longitudinal streaks are formed in an image, longitudinal streak Δ indicates a state where some longitudinal streaks are formed in an image. As shown in FIG. 8, it was found that the formation of longitudinal streaks is suppressed in the range of the retracted height H of 0 to 1.5 mm. Further, the retracted height H is more preferably in the range of 0 to 1.0 mm. This is because the toner slightly adheres to a part of the magnet plate 70 exposed on an upstream side surface when the retracted height H is in the range of 1.0 mm to 1.5 mm. Further, the axial inclination and shape of the lower end portion 80S1 may appear as a density gradient in an image when the retracted height H is shorter than 0 mm, i.e. when the lower end portion 80S1 of the nonmagnetic plate 80 projects more downward than the magnet lower end portion 70S1 of the magnet plate 70. Thus, the retracted height H is preferably equal to or longer than 0 mm.

<Concerning Retracted Height H and Thickness W of the Nonmagnetic Plate 80>

Figure 9:
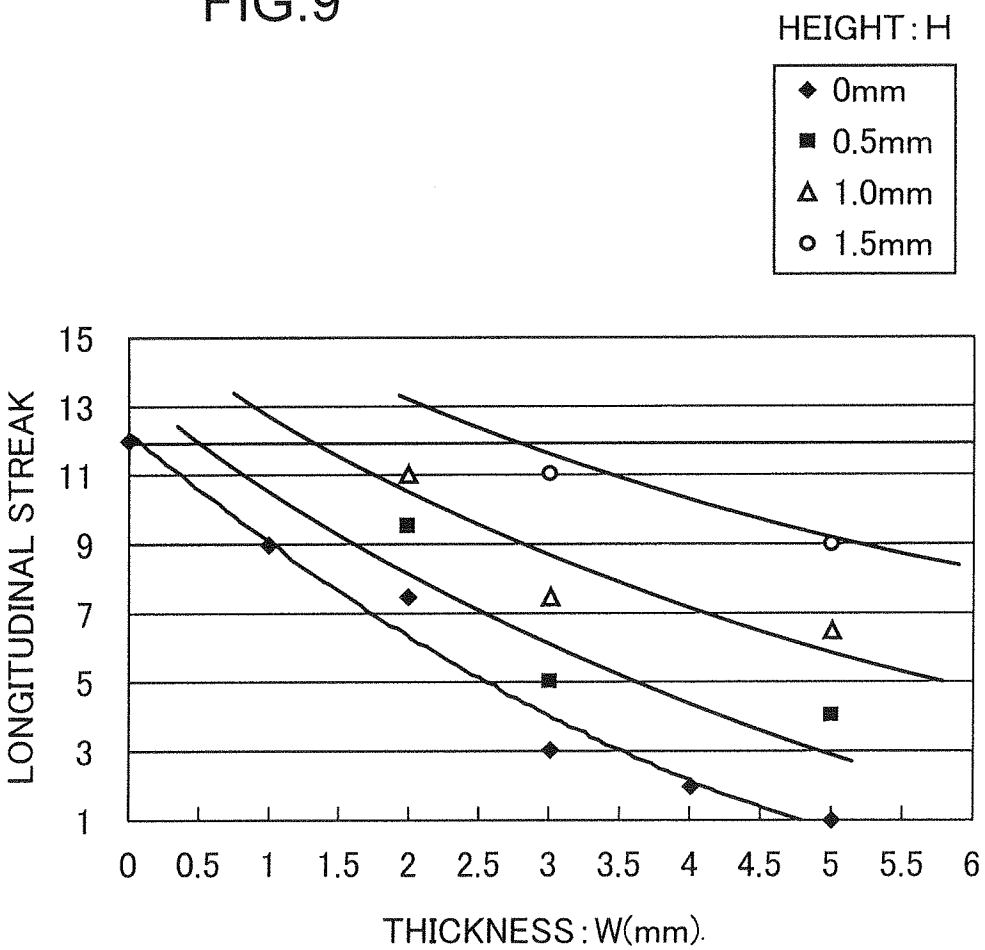
FIG. 9 shows an evaluation result on retracted height H and thickness W of the nonmagnetic member according to the embodiment of the present disclosure.
Figure 9:
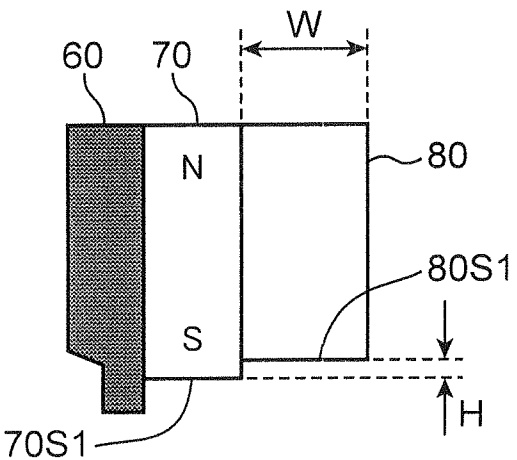

Next, a preferable relationship between the thickness W and the retracted height H of the nonmagnetic plate 80 is described with reference to FIG. 9. The thickness W of the nonmagnetic plate 80 is a thickness in the rotation direction of the developing roller 331. For details, the thickness W of the nonmagnetic plate 80 is a thickness in the tangential direction of the sleeve 331S at a position of the sleeve 331S which is most nearly to the nonmagnetic plate 80 in the sleeve 331S in a section view intersecting with a cylindrical shaft of the sleeve 331S. A longitudinal axis of a graph of FIG. 9 represents longitudinal streak level. The longitudinal streak level is an evaluation result of the above longitudinal streaks in 12 levels. Longitudinal streak level 1 indicates a state where no longitudinal streak is formed, and longitudinal streak level 12 indicates a state where longitudinal streaks are notably formed. Note that longitudinal streak level 12 is equal to an image level when the nonmagnetic plate 80 is not provided in the developing device 33 as shown in FIG. 6A. Further, an average longitudinal streak level of four samples of half-tone images on each condition is shown in the graph of FIG. 9.

In this evaluation, the longitudinal streak level was evaluated after the retracted height H was changed for a plurality of nonmagnetic plates 80 having different thicknesses W. As a result, it was found that the shorter the retracted height H, the better the longitudinal streak level and the larger the thickness W, the better the longitudinal streak level. The retracted height H which provides a result equal to longitudinal streak level 12 in the case where the nonmagnetic plate 80 is not provided is as shown in Table-1 under each condition of the thickness W of the nonmagnetic plate 80.

TABLE 1

| RETRACTED HEIGHT: H (mm) | THICKNESS: W (mm) |
|---|---|
| 0 | 0 |
| 0.5 | 0.5 |
| 1.0 | 1.2 |
| 1.5 | 2.5 |

Figure 10:
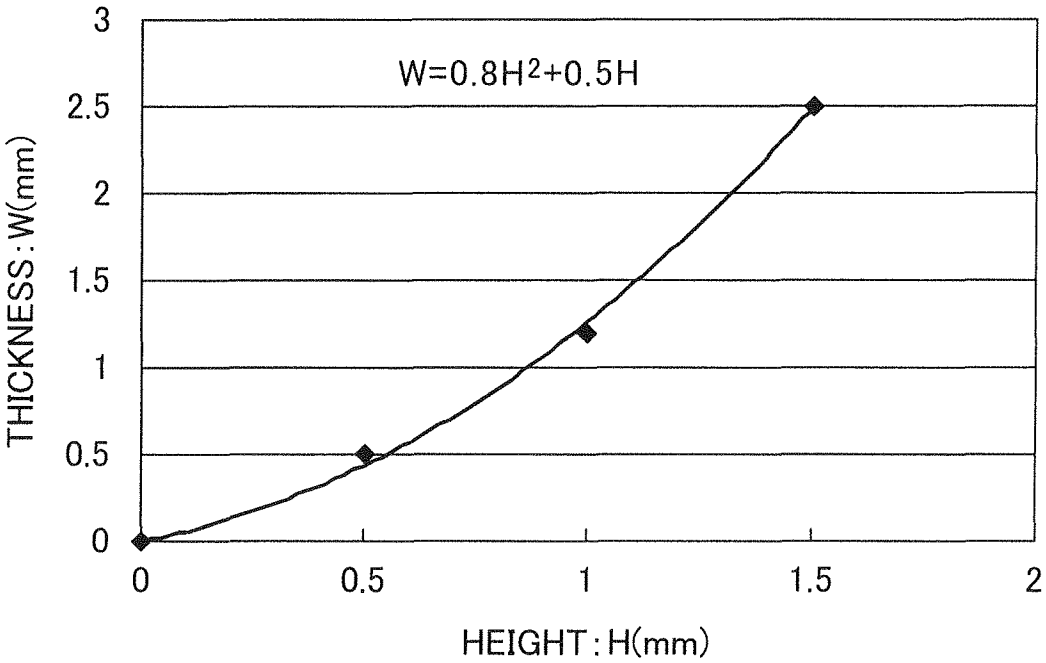
FIG. 10 shows an evaluation result on retracted height H and thickness W of the nonmagnetic member according to the embodiment of the present disclosure.
Figure 10:
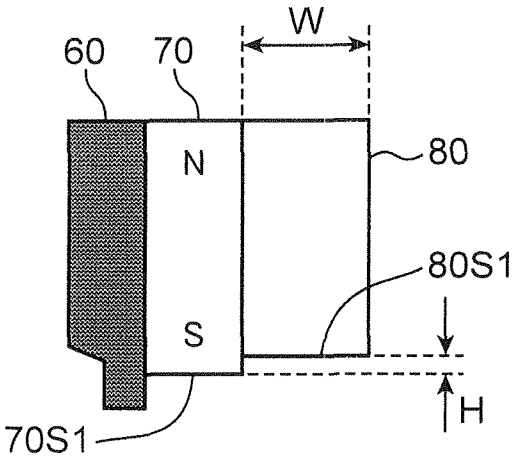

A graph showing a relationship between the thickness W and the retracted height H shown in Table-1 is shown in FIG. 10. It was found that the longitudinal streak level was good in an area of FIG. 10 to the left of (above) a curve. As a result, an ability to convey the toner toward the layer restricting member is maintained high and the longitudinal streak level is particularly preferably improved by the nonmagnetic plate 80 if the thickness W and the retracted height H (≥0) of the nonmagnetic plate 80 satisfies the following relationship:

$$\text{Thickness } W > 0.8\times(\text{retracted height } H)^2 + 0.5\times(\text{retracted height } H) \quad (1).$$

<Concerning the Arrangement of the Upstream End Portion of the Nonmagnetic Plate 80>

Figure 11:
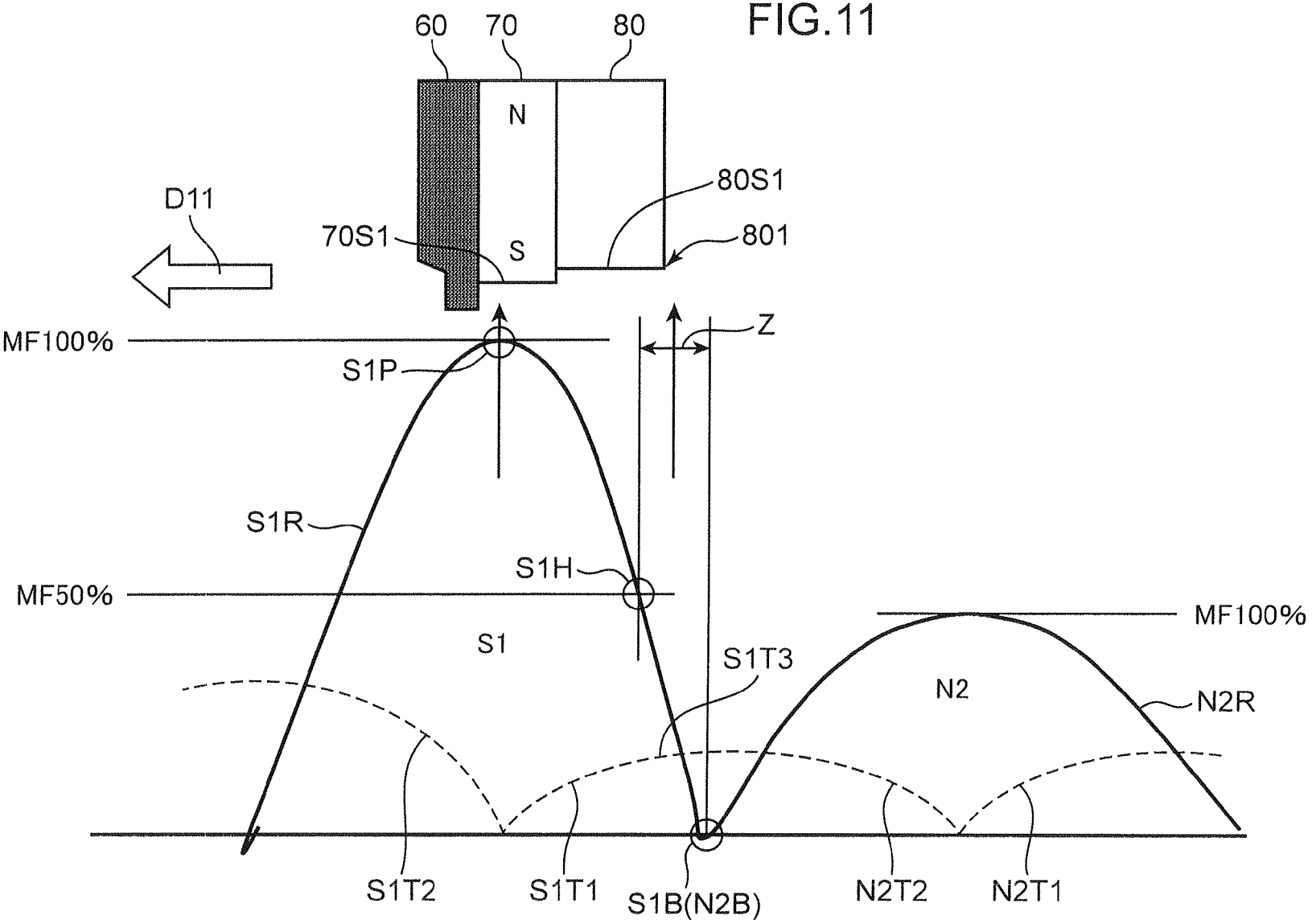
FIG. 11 is a diagram showing the arrangement of the nonmagnetic member according to the embodiment of the present disclosure.

Next, a preferable arrangement of the nonmagnetic plate is described with reference to FIG. 11. FIG. 11 is a view diagrammatically showing magnetic force patterns of the N2 pole and the S1 pole out of the magnet 331M of the developing roller 331 and showing an arrangement of the magnet plate 70 and the nonmagnetic plate 80 in the circumferential direction relative to a magnetic force pattern of the S1 pole. The toner is conveyed on the developing roller 331 from the right side toward the left side of FIG. 11 (direction of arrow D11). Out of a curve indicating a magnetic force pattern, a radial magnetic force S1R of the S1 pole and a radial magnetic force N2R of the N2 pole respectively show distributions of the magnetic forces of the S1 pole and the N2 pole in the radial direction. A start point S1B of the S1 pole (end point N2B of the N2 pole) is located on a boundary between the S1 pole and the N2 pole. Further, a first circumferential magnetic force S1T1 of the S1 pole and a second circumferential magnetic force S1T2 of the S1 pole are distributions of magnetic forces of the S1 pole in the circumferential (tangential) direction and respectively show distributions of upstream and downstream sides of the S1 pole in the rotation direction of the developing roller 331. Similarly, a first circumferential magnetic force N2T1 of the N2 pole and a second circumferential magnetic force N2T2 of the N2 pole are distributions of magnetic forces of the N2 pole in the circumferential (tangential) direction and respectively show distributions of upstream and downstream sides of the N2 pole in the rotation direction of the developing roller 331. Further, in FIG. 11, MF 100% and MF 50% respectively indicate a position of a maximum magnetic force of each magnetic pole and a position where the magnetic force is 50% of the maximum magnetic force.

As described above, the repulsive magnetic field is formed between the S1 pole of the magnet 331M of the developing roller 331 and the S pole of the magnet plate 70. Thus, as shown in FIG. 11, the magnet plate 70 is arranged to face the peak magnetic force S1P of the radial magnetic force of the S1 pole of the magnet 331M. On the other hand, an upstream end portion 80S1 of the lower end portion 80S1 of the nonmagnetic plate 80 corresponding to an upstream end portion of the developing roller 331 in the rotation direction is desirably arranged to face an area Z of the S1 pole. Here, the area Z is a position where the radial magnetic force of the S1 pole is 50% of the peak magnetic force S1P and corresponds to an area from an upstream position of the developing roller 331 in the rotation direction (half-value position S1H of the S1 pole) to the start point S1B of the S1 pole (end point N2B of the N2 pole).

Table-2 shows an evaluation result on longitudinal streaks and density uniformity when the position of the upstream end portion 801 was changed by changing the thickness W of the nonmagnetic plate 80 with the layer restricting member 60 and the magnet plate 70 fixed.

If a large amount of toner clumps between the periphery of the layer restricting member 60 and the developing roller 331, a rotational torque of the developing roller 331 increases and vibration is generated when the developing roller 331 is driven and rotated. As a result, an image defect corresponding to the pitch of an unillustrated drive gear for transmitting a rotational drive force to the developing roller 331 is formed in a printed image. This image defect is called density nonuniformity of the gear pitch. In Table-2, density uniformity ○ indicates a state where there is no density nonuniformity of the gear pitch on a pint and density uniformity Δ indicates a state where there is some density uniformity of the gear pitch.

TABLE 2

| | SIDE OF S1 POLE | | | | | | | | SIDE OF N2 POLE |
|---|---|---|---|---|---|---|---|---|---|
| | 70% | 60% | 50% | 40% | 30% | 20% | 10% | 0% | 10% |
| LONGITUDINAL STREAKS | Δ | Δ | ○ | ○ | ○ | ○ | ○ | ○ | ○ |
| DENSITY UNIFORMITY | ○ | ○ | ○ | ○ | ○ | ○ | ○ | ○ | Δ |

As shown in Table-2, longitudinal streaks are solved satisfactorily by arranging the upstream end portion 801 of the nonmagnetic plate 80 at a side (0% side of Table-2) upstream of the half-value position S1H (50% of Table-2) of the S1 pole. This is because the circumferential magnetic force of the S1 pole (first circumferential magnetic force S1T1 of the S1 pole) is increased (SIT3 of FIG. 11) in the area Z to accelerate the movement of the toner in the circumferential direction. Specifically, by arranging the upstream end portion 801 in the area Z, a binding force to move the toner in the radial direction is weakened and the fluidity of the toner in the rotation direction of the developing roller 331 is improved. On the other hand, if the upstream end portion 801 of the nonmagnetic plate 80 is located upstream of the area Z and faces an area corresponding to the N2 pole (10% of the N2 pole), density uniformity is slightly deteriorated due to the gear pitch. This is because an increase in the torque of the developing roller 331 is caused since in the amount of the toner retained between the nonmagnetic plate 80 and the developing roller 331 is increased as the thickness W of the nonmagnetic plate 80 increases. As just described, it is preferable to arrange the upstream end portion 801 of the nonmagnetic plate 80 to face the area Z extending from the upstream end (S1B) of the radial magnetic force distribution of the S1 pole of the magnet 331M in the rotation direction as a start point to the position (S1H) upstream of the position (S1P) with the maximum magnetic force of the S1 pole in the rotation direction and having a magnetic force, which is 50% of the maximum magnetic force of the S1 pole, as an end point in a section view intersecting with a cylindrical shaft of the sleeve 331S.

<Concerning Axial End Portions of the Nonmagnetic Plate 80>

Figure 12:
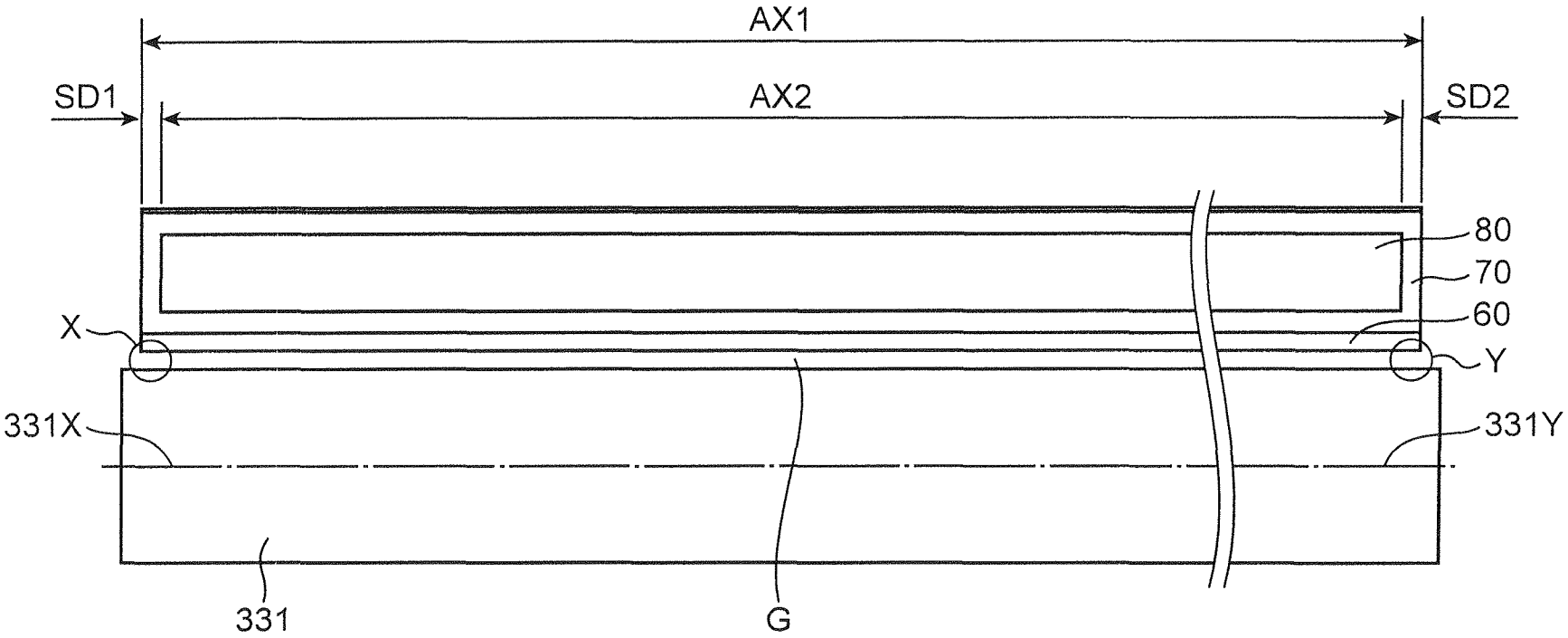
FIG. 12 is a view showing a positional relationship of the nonmagnetic member in an axial direction according to the embodiment of the present disclosure.

Next, a preferable arrangement of the nonmagnetic plate 80 in the axial direction is described with reference to FIG. 12. FIG. 12 is a view showing a positional relationship of the developing roller 331, the layer restricting member 60, the magnet plate 70 and the nonmagnetic plate 80 in an extending direction of the rotary shaft of the developing roller 331. FIG. 12 is a view when viewed from an upstream side in the rotation direction of the developing roller 331. The developing roller 331 extends axially more outward than the layer restricting member 60. The magnet plate 70 has a length substantially equal to that of the layer restricting member 60 and is fixed to the layer restricting member 60. On the other hand, the nonmagnetic plate 80 is arranged axially more inwardly than the magnet plate 70. In other words, axial length AX2 of the nonmagnetic plate 80 is shorter than axial length AX1 of the magnet plate 70. As a result, areas SD1, SD2 where the nonmagnetic plate 80 is not arranged are present at opposite axial ends of the nonmagnetic plate 80.

In manufacturing the developing roller 331, a magnetic force is increased since lines of magnetic force are formed between a magnet side surface and a circumferential surface of the developing roller 331 on opposite axial end portions 331X, 331Y. In this case, a toner layer becomes thicker on opposite axial end portions X, Y of the developing roller 331 on the outer surface of the developing roller 331. When a large amount of the toner carried on the developing roller 331 is conveyed to a side below the nonmagnetic plate 80 and the magnet plate 70 as a result of this, the toner tries to move to an area with a lower pressure. Thus, the toner moves toward sides more axially outward of the areas X and Y. As a result, the pressure of the toner is further increased on opposite end portions of the layer restricting member 60. Thus, it is desirable to reduce a pressure acting on the toner on opposite end portions of the magnet plate 70 to suppress an increase in the pressure of the toner on the opposite end portions of the layer restricting member 60. Thus, as shown in FIG. 12, the nonmagnetic plate 80 is preferably arranged inwardly of the magnet plate 70 on the opposite axial end portions.

As described above, in the above embodiment, the developing roller 331 includes the sleeve 331 which is driven and rotated and the magnet 331M included inside the sleeve. The thickness of the toner on the sleeve 331S is restricted by the layer restricting member 60 arranged at a distance from the sleeve 331S of the developing roller 331. Further, the magnet plate 70 is arranged upstream of the layer restricting member 60 in the rotation direction. The magnet plate 70 includes the magnet lower end portion 70S1 facing one magnetic pole S1 out of a plurality of magnetic poles of the magnet 331M and the magnetic pole having the same polarity as the one magnetic pole is provided on the magnet lower end portion 70S1. Further, the nonmagnetic plate 80 is arranged upstream of the magnet plate 70 in the rotation direction and at a distance from the sleeve 331S. The magnetic toner conveyed toward the layer restricting member 60 on the sleeve 331S is formed into a thin layer by a magnetic field acting between the same poles of the magnet plate 70 and the magnet 331M. At this time, since the nonmagnetic plate 80 is arranged upstream of the magnet plate 70 in the rotation direction, the adherence of the magnetic toner to the magnet plate 70 is suppressed at the side upstream of the magnet plate 70 in the rotation direction. As a result, the concentration of the magnetic force is moderated and the pressure subjected to the magnetic toner is reduced when the magnetic toner passes between the magnet plate 70 and the developing roller 331. Thus, in the process of restricting the layer of the magnetic toner by the layer restricting member 60, the stress subjected to the magnetic toner is reduced and the layer restriction of the magnetic toner is realized after the magnetic toner is formed into a thin layer.

According to the above embodiment, the vertical wall 80S2 of the nonmagnetic plate 80 is arranged in close contact with the magnet vertical wall 70S2 on the upstream side of the magnet plate 70 in the rotation direction. As a result, the entrance of the magnetic toner between the magnet plate 70 and the nonmagnetic plate 80 is prevented.

According to the above embodiment, the lower end portion 80S1 of the nonmagnetic plate 80 and the magnet lower end portion 70S1 of the magnet plate 70 are flush with each other. Thus, the lower end portion 80S1 does not project toward the sleeve 331S of the developing roller 331 more than the magnet lower end portion 70S1. As a result, the flow of the toner is not obstructed and a density gradient of a toner image is prevented.

According to the above embodiment, the lower end portion 80S1 of the nonmagnetic plate 80 is arranged at a longer distance from the sleeve 331S than the magnet lower end portion 70S1 of the magnet plate 70. Thus, the lower end portion 80S1 does not project toward the sleeve 331S of the developing roller 331 from the magnet lower end portion 70S1. As a result, the flow of the toner is not obstructed and a density gradient of a toner image is more prevented.

According to the above embodiment, even if a large amount of the magnetic toner is conveyed at the opposite axial end portions of the sleeve 331S when the magnetic toner is conveyed on the sleeve 331S toward the layer restricting member 60, it is prevented that a large amount of the magnetic toner is pressed toward the opposite end portions of the layer restricting member 60 since the opposite end portions of the nonmagnetic plate 80 are arranged more inwardly of those of the magnet plate 70.

According to the above embodiment, the nonmagnetic plate 80 is arranged to face the area where the circumferential magnetic force of one magnetic pole is large. This accelerates the movement of the magnetic toner in the circumferential direction and improves the fluidity of the magnetic toner conveyed toward the layer restricting member 60. Further, the upstream end portion 801 of the nonmagnetic plate 80 in the rotation direction does not face the N2 pole upstream of the S1 pole. Thus, it is prevented that a large amount of the magnetic toner flows into between the nonmagnetic plate 80 and the sleeve 331S to increase a rotational torque of the sleeve 331S. As a result, gear pitch nonuniformity in a toner image is suppressed.

Although the developing device 33 including the nonmagnetic plate 80 according to the embodiment of the present disclosure and the image forming apparatus 1 including this developing device 33 have been described above, the present disclosure is not limited to this. For example, the following modifications can be made.

(1) Although the nonmagnetic plate 80 is formed of the plate-like member made of ABS resin containing carbon in the above embodiment, the present disclosure is not limited to this. Another material may be used if the nonmagnetic plate 80 is made of a nonmagnetic material. Note that if a nonmagnetic and electrically conductive material such as aluminum is used for the nonmagnetic plate 80, the developing roller 331 and the nonmagnetic plate 80 may be set at the same potential by an unillustrated conductive path. In this case, the developing bias applied to the developing roller 331 is also applied to the nonmagnetic plate 80 to set the developing roller 331 and the nonmagnetic plate 80 at the same potential. In this case, it is prevented that the toner conveyed by the developing roller 331 and held in contact with the nonmagnetic plate 80 is abnormally charged. As a result, the occurrence of toner fogging on the photoconductive drum 31 is suppressed.

(2) Although the magnet 331M of the developing roller 331 has four magnetic poles in the above embodiment, the present disclosure is not limited to this. The magnet 331M only has to have a plurality of magnetic poles and the magnetic pole of the magnet 331M arranged to face the magnet plate 70 is not limited to the S pole. An S pole or an N pole may be arranged to face the magnet plate 70 according to how the developing roller 31 is used. In this case, a magnetic force having the same polarity as the facing magnetic pole of the magnet 331M is set on the magnet lower end portion 70S1 of the magnet plate 70.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device, comprising:

a developer bearing member which has a hollow cylindrical shape, is driven and rotated and includes a sleeve for bearing magnetic toner on a circumferential surface and a fixed magnet included inside the sleeve and having a plurality of magnetic poles in a circumferential direction of the sleeve;

a layer restricting member which faces one magnetic pole out of the plurality of magnetic poles of the fixed magnet, is arranged at a distance from the sleeve and made of a magnetic material and restricts the thickness of the magnetic toner on the sleeve;

a facing magnet which is arranged upstream of the layer restricting member in a rotation direction of the sleeve and at a distance from the sleeve, includes a first facing surface facing a position overlapping with a position with a maximum magnetic force of the one magnetic pole out of the plurality of magnetic poles in a radial direction and has a magnetic pole having the same polarity as the one magnetic pole on the first facing surface; and a nonmagnetic member which is connected at an upstream side of the facing magnet in the rotation direction and arranged at a distance from the sleeve.

2. A developing device according to claim 1, wherein:

the facing magnet includes a first wall portion intersecting with the first facing surface at an upstream side of the first facing surface in the rotation direction and is located in a direction away from the sleeve;

the nonmagnetic member includes a second facing surface facing the sleeve and a second wall portion intersecting with the second facing surface at a downstream side of the second facing surface in the rotation direction and standing in a direction away from the sleeve; and the second wall portion of the nonmagnetic member is arranged in close contact with the first wall portion of the facing magnet.

3. A developing device according to claim 2, wherein:

the nonmagnetic member and the facing magnet are so arranged that the second facing surface of the nonmagnetic member and the first facing surface of the facing magnet are flush with each other.

4. A developing device according to claim 2, wherein:

the second facing surface of the nonmagnetic member is arranged at a longer distance from the sleeve than the first facing surface of the facing magnet.

5. A developing device according to claim 2, wherein:

opposite end portions of the nonmagnetic member are arranged more inwardly than opposite end portions of the facing magnet in an axial direction of a cylindrical shaft of the sleeve.

6. A developing device according to claim 2, wherein:

an upstream end portion of the second facing surface of the nonmagnetic member in the rotation direction is arranged to face an area extending from an upstream end of a radial magnetic force distribution of the one pole of the fixed magnet in the rotation direction as a start point to a position upstream of the position with the maximum magnetic force of the one pole in the rotation direction and having a magnetic force, which is 50% of the maximum magnetic force of the one pole, as an end point in a section view intersecting with a cylindrical shaft of the sleeve.

7. A developing device according to claim 2, wherein:

the following relationship is satisfied:

$$W>0.8\times H^2+0.5\times H(H\geq 0),$$

when H (mm) denotes a distance by which the second facing surface of the nonmagnetic member is more distant from the sleeve than the facing surface of the facing magnet and W (mm) denotes the thickness of the second facing surface of the nonmagnetic member in the rotation direction.

8. A developing device according to claim 1, wherein:

the nonmagnetic member is made of an electrically conductive material and set at the same potential as the sleeve.

9. An image forming apparatus, comprising:

an image bearing member on a surface of which an electrostatic latent image is to be formed; and a developing device which supplies toner to the image bearing member;

wherein the developing device includes;

a developer bearing member which has a hollow cylindrical shape, is driven and rotated and includes a sleeve for bearing magnetic toner on a circumferential surface and a fixed magnet included inside the sleeve and having a plurality of magnetic poles in a circumferential direction of the sleeve;

a layer restricting member which faces one magnetic pole out of the plurality of magnetic poles of the fixed magnet, is arranged at a distance from the sleeve and made of a magnetic material and restricts the thickness of the magnetic toner on the sleeve;

a facing magnet which is arranged upstream of the layer restricting member in a rotation direction of the sleeve and at a distance from the sleeve, includes a first facing surface facing a position overlapping with a position with a maximum magnetic force of the one magnetic pole out of the plurality of magnetic poles in a radial direction and has a magnetic pole having the same polarity as the one magnetic pole on the first facing surface; and a nonmagnetic member which is connected at an upstream side of the facing magnet in the rotation direction and arranged at a distance from the sleeve.

10. An image forming apparatus according to claim 9, wherein the facing magnet includes a first wall portion intersecting with the first facing surface at an upstream side of the first facing surface in the rotation direction and is located in a direction away from the sleeve;

the nonmagnetic member includes a second facing surface facing the sleeve and a second wall portion intersecting with the second facing surface at a downstream side of the second facing surface in the rotation direction and standing in a direction away from the sleeve; and the second wall portion of the nonmagnetic member is arranged in close contact with the first wall portion of the facing magnet.

11. An image forming apparatus according to claim 10, wherein:

the nonmagnetic member and the facing magnet are so arranged that the second facing surface of the nonmagnetic member and the first facing surface of the facing magnet are flush with each other.

12. An image forming apparatus according to claim 10, wherein:

the second facing surface of the nonmagnetic member is arranged at a longer distance from the sleeve than the first facing surface of the facing magnet.

13. An image forming apparatus according to claim 10, wherein:

opposite end portions of the nonmagnetic member are arranged more inwardly than opposite end portions of the facing magnet in an axial direction of a cylindrical shaft of the sleeve.

14. An image forming apparatus according to claim 10, wherein:

an upstream end portion of the second facing surface of the nonmagnetic member in the rotation direction is arranged to face an area extending from an upstream end of a radial magnetic force distribution of the one pole of the fixed magnet in the rotation direction as a start point to a position upstream of the position with the maximum magnetic force of the one pole in the rotation direction and having a magnetic force, which is 50% of the maximum magnetic force of the one pole, as an end point in a section view intersecting with a cylindrical shaft of the sleeve.

15. An image forming apparatus according to claim 10, wherein:

the following relationship is satisfied:

$$W>0.8\times H^2+0.5\times H(H\geq 0),$$

when H (mm) denotes a distance by which the second facing surface of the nonmagnetic member is more distant from the sleeve than the facing surface of the facing magnet and W (mm) denotes the thickness of the second facing surface of the nonmagnetic member in the rotation direction.

16. An image forming apparatus according to claim 9, wherein:

the nonmagnetic member is made of an electrically conductive material and set at the same potential as the sleeve.

* * * * *